US009109483B2

(12) United States Patent
Winkel

(10) Patent No.: US 9,109,483 B2
(45) Date of Patent: Aug. 18, 2015

(54) EXHAUST SYSTEM FOR AN INTERNAL COMBUSTION ENGINE

(71) Applicant: Dr. Ing. h.c. F. Porsche Aktiengesellschaft, Stuttgart (DE)

(72) Inventor: Joerg Winkel, Weissach (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 14/105,837

(22) Filed: Dec. 13, 2013

(65) Prior Publication Data

US 2014/0166394 A1 Jun. 19, 2014

(30) Foreign Application Priority Data

Dec. 17, 2012 (DE) ..... 10 2012 112 433

(51) Int. Cl.

| | |
|---|---|
| ***F01N 1/08*** | (2006.01) |
| ***F01N 1/02*** | (2006.01) |
| ***F01N 13/10*** | (2010.01) |
| ***F01N 1/16*** | (2006.01) |

(52) U.S. Cl.

CPC *F01N 1/02* (2013.01); *F01N 1/166* (2013.01); *F01N 13/107* (2013.01); *F01N 2240/36* (2013.01)

(58) Field of Classification Search

CPC ..... F01N 1/08
USPC ..... 181/238, 237, 254
See application file for complete search history.

(56) References Cited

U.S. PATENT DOCUMENTS

| | | | | |
|---|---|---|---|---|
| 7,090,048 | B2 | 8/2006 | Albertson et al. | |
| 8,418,445 | B2 * | 4/2013 | Laube et al. | 60/299 |
| 2004/0006970 | A1 * | 1/2004 | Worner et al. | 60/272 |
| 2007/0227807 | A1 * | 10/2007 | Meneely et al. | 181/237 |
| 2007/0272480 | A1 * | 11/2007 | Kuroda et al. | 181/254 |
| 2008/0078613 | A1 * | 4/2008 | Liu | 181/237 |
| 2008/0302597 | A1 * | 12/2008 | Kruger et al. | 181/238 |

FOREIGN PATENT DOCUMENTS

| | | | |
|---|---|---|---|
| DE | 197 43 446 | A1 | 12/1998 |
| DE | 102 31 056 | A1 | 2/2004 |
| DE | 10 2006 020 155 | A1 | 6/2007 |

OTHER PUBLICATIONS

German Search Report, dated Jun. 20, 2013, corresponding to German counterpart Patent Application No. 10 2012 112 433.7, with partial English translation.

* cited by examiner

*Primary Examiner* — Forrest M Phillips
(74) *Attorney, Agent, or Firm* — RatnerPrestia

(57) ABSTRACT

An exhaust system for an internal combustion engine, having a first exhaust tract and a second exhaust tract, wherein a first silencer device is arranged in an end section of the first exhaust tract and a second silencer device is arranged in an end section of the second exhaust tract, and the two exhaust tracts are connected in an inter-communicating manner by a crosstalk point, and, in the first or second exhaust tract downstream of the crosstalk point, there is provided a valve for the selective closure of the respective exhaust tract, wherein a distance between the valve and the crosstalk point is dimensioned such that, at a particular rotational speed of the engine, an exhaust line path between the valve and the crosstalk point serves as a quarter lambda resonator such that, at the rotational speed of the internal combustion engine, disturbing noises of the exhaust system are reduced.

6 Claims, 2 Drawing Sheets

EXHAUST SYSTEM FOR AN INTERNAL COMBUSTION ENGINE

CROSS-REFERENCE TO RELATED APPLICATIONS

This application claims priority to German Patent Application No. 10 2012 112 433.7, filed Dec. 17, 2012, which is incorporated by reference herein in its entirety.

FIELD OF THE INVENTION

The invention relates to an exhaust system for an internal combustion engine.

BACKGROUND OF THE INVENTION

During the operation of modern internal combustion engines, in particular in the case of internal combustion engines with two rows of cylinders, disturbing exhaust-gas noises commonly arise in the exhaust tract depending on the configuration and arrangement of silencer devices. DE 197 43 446 A1, which is incorporated by reference herein, discloses an exhaust system for an internal combustion engine, in which a silencer is designed as a Helmholtz resonator. A closable exhaust-gas flap is provided at said silencer. By virtue of said exhaust-gas flap being closed, an escape of the exhaust-gas flow from said silencer is prevented. Said silencer thus acts as a Helmholtz resonator.

DE 102 31 056 A1, which is incorporated by reference herein, describes an exhaust system which has two silencer devices through which flow can pass in parallel. The silencer devices are designed differently with regard to silencing action and throughflow resistance. Here, depending on the load point of the internal combustion engine, the entire exhaust-gas flow is diverted into one or the other silencer device by means of a switching device.

Furthermore, DE 10 2006 020 155 A1, which is incorporated by reference herein, discloses an exhaust system for an internal combustion engine, in which, in a tailpipe of an exhaust tract, there is arranged an exhaust-gas flap which is closed or opened as a function of the engine rotational speed.

SUMMARY OF THE INVENTION

An exhaust system which, at critical rotational speeds of the internal combustion engine, permits an improved damping action for minimizing disturbing exhaust-gas noises.

The exhaust system according to aspects of the invention is characterized in that a distance between a valve and a crosstalk point is dimensioned such that, at a particular rotational speed of the internal combustion engine, an exhaust line path between the valve and the crosstalk point serves as a quarter lambda resonator such that, at said rotational speed of the internal combustion engine, disturbing noises of the exhaust system are reduced or eliminated. The valve is preferably in the form of an exhaust-gas flap. By virtue of the exhaust-gas flap being closed, the entire exhaust-gas flow from the internal combustion engine is conducted into the atmosphere through the other exhaust tract, in which the exhaust-gas flap is not positioned. The exhaust line path between the crosstalk point and the closed exhaust-gas flap acts as a quarter lambda resonator, by virtue of said exhaust line path being dimensioned by way of example such that the distance between crosstalk point and exhaust-gas flap amounts to approximately twice the wavelength to be reduced. According to aspects of the invention, it is hereby possible for droning noises of the exhaust system with low frequencies, in particular in a rotational speed range between 1000 and 2000 rpm, to be minimized. Such noises arise in particular in the interior of the vehicle and thus can be minimized effectively. The valve may be arranged as desired so as to be positioned in an end section of the respective exhaust tract.

In one refinement of the invention, the crosstalk point is in the form of a third silencer device. In particular, the third silencer device is configured as a central silencer positioned in a central region of the exhaust system. The crosstalk point is alternatively in the form of a connecting pipe. The crosstalk point may be positioned as desired, provided that the distance between the valve and the crosstalk point is dimensioned, according to aspects of the invention, such that a reduction of the disturbing frequencies is realized in an effective manner by means of the quarter lambda resonator arrangement.

In a further refinement of the invention, the valve can be actuated as a function of the engine load and/or rotational speed of the internal combustion engine. The valve is preferably actuated in a rotational speed range between 1000 and 2000 rpm. In said rotational speed range, droning noises occur within the exhaust system, which noises adversely affect the driving comfort characteristics in the interior of the vehicle. Said low-frequency droning is minimized in an effective manner by means of the dimensioning, according to aspects of the invention, of the exhaust line path between the valve position and the crosstalk point position.

In a further refinement of the invention, an exhaust-gas flap is provided in the connecting pipe or within the third silencer device, by means of which exhaust-gas flap a mixing of the exhaust-gas streams between the first exhaust tract and the second exhaust tract is prevented in accordance with the load point of the internal combustion engine.

BRIEF DESCRIPTION OF THE DRAWINGS

Further features and combinations of features will emerge from the description. Specific exemplary embodiments of the invention are illustrated in simplified form in the drawings and will be explained in more detail in the following description, in which.

DETAILED DESCRIPTION OF THE INVENTION

Figure 1:
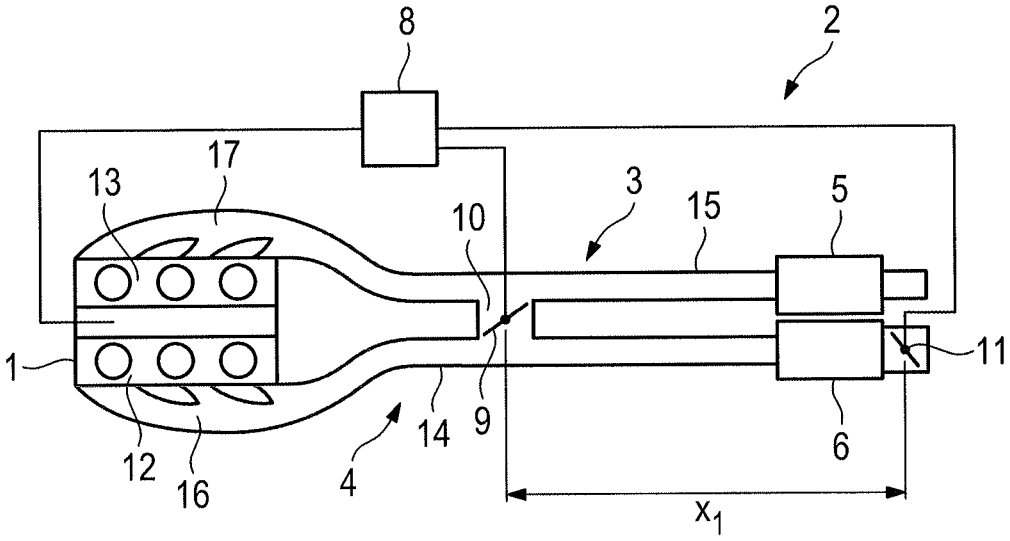
FIG. 1 is a schematic illustration of an exhaust system according to aspects of the invention, as per a first embodiment.

FIG. 1 shows an internal combustion engine 1 having two rows of cylinders and having an exhaust system 2. The exhaust system 2 comprises a first exhaust tract 3 and a second exhaust tract 4. The exhaust gases of the first bank of cylinders pass into the atmosphere through the first exhaust tract 3. The exhaust gases of the second bank of cylinders pass into the atmosphere through the second exhaust tract 4. A first silencer device 5 is positioned at the end of the first exhaust tract. A second silencer device 6 is positioned at the end of the second exhaust tract 4.

Between the first exhaust tract 3 and the second exhaust tract 4 there is provided a crosstalk point 10 which connects the two exhaust tracts in an inter-communicating manner.

Within the crosstalk point 10, there is provided a closable exhaust-gas flap 9 which, in a closed position, prevents mixing of the exhaust gases between the two exhaust tracts. In a first exemplary embodiment of the invention, the crosstalk point 10 is in the form of a connecting pipe, as per FIG. 1. In a second exemplary embodiment of the invention, the crosstalk point 10 is in the form of a third silencer device 7.

The first exhaust tract 3 comprises a first exhaust manifold 17 and a first exhaust line 15 through which the exhaust gases of the first bank of cylinders 13 are conducted into the atmosphere. The second exhaust tract 4 comprises a second exhaust manifold 16 and a second exhaust line 14 through which the exhaust gases of the second bank of cylinders 12 are conducted into the atmosphere. Mixing of the exhaust gases of the two exhaust tracts 3 and 4 through the connecting pipe or through the third silencer device 7 is achieved by virtue of the flap 9 being opened. In FIG. 1, a valve 11 is positioned in the second exhaust tract 4 downstream of the second silencer device 6. The valve 11 is in the form of an exhaust-gas flap which is actuated as a function of an operating point of the internal combustion engine 1. By means of the valve 11, the second exhaust tract 4 can be closed, such that when the exhaust-gas flap 9 is opened, the entire exhaust-gas flow from the internal combustion engine 1 is conducted into the atmosphere via the first exhaust tract 3.

The crosstalk point 10 serves for gas exchange and as a reflection point within the exhaust system 2. The torque, and the torque profile, can be influenced in this way. The crosstalk point 10 nevertheless has an influence on the gas pulsations within the exhaust system 2. Furthermore, the crosstalk point 10 influences the engine-specific gas-exchange orders and thus has an effect on the noise made by the exhaust system 2. Consequently, as a result of the gas exchange, the excitation pulses of the internal combustion engine run symmetrically through the exhaust tracts 3 and 4 downstream of the crosstalk point 10. The exhaust gases thus emerge into the atmosphere both from the first exhaust tract 3 and also from the second exhaust tract 4 simultaneously. The in-phase excitations lead to interference which, at certain rotational speeds of the internal combustion engine 1, can be perceived as being disturbing. In particular at low rotational speeds or in the case of low frequencies of the noises, such interference can lead to disturbing droning noises. To minimize or eliminate such negative droning noises, the valve 11 is spaced apart from the crosstalk point 10 such that, when the valve 11 is closed, and at the rotational speeds at which disturbing exhaust-gas noises arise, an exhaust line path $x_1$ between the valve 11 and the crosstalk point 10 serves as a quarter lambda resonator. When the valve 11 is closed, the exhaust line path $x_1$ acts as a quarter lambda resonator. The disturbing droning noises of the exhaust system 2 are consequently minimized.

Figure 2:
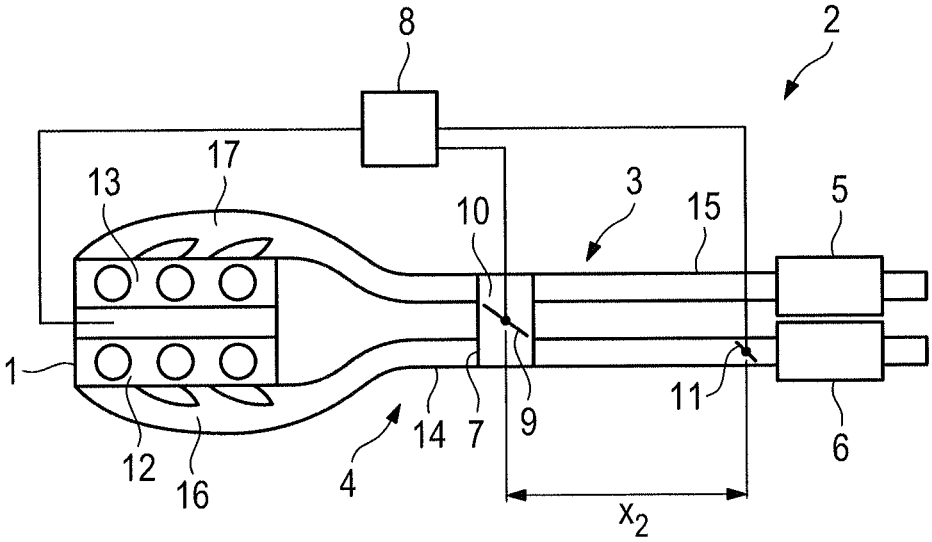
FIG. 2 is a schematic illustration of a second embodiment of the exhaust system according to aspects of the invention.

The valve 11 may be positioned as desired. In FIG. 1, the valve 11 is positioned downstream of the second silencer device 6. In the second exemplary embodiment as per FIG. 2, the valve 11 is positioned upstream of the second silencer device 6. The positioning of the valve 11 is independent of whether the crosstalk point 10 is in the form of a connecting pipe or in the form of a third silencer device. According to aspects of the invention, the valve 11 should be positioned such that the distance between the crosstalk point 10 and the valve 11 is dimensioned such that said distance corresponds to twice the wavelength of the frequency to be reduced. For this purpose, the actuating devices (not illustrated) of the valve 11 and of the exhaust-gas flap 9 are connected to a control unit 8, which is likewise connected to the internal combustion engine 1. It is thus possible for both the exhaust-gas flap 9 and also the valve 11 to be actuated as a function of engine load and/or rotational speed of the internal combustion engine 1. In addition, or alternatively, both the exhaust-gas flap 9 and also the valve 11 may be actuated as a function of other engine parameters. The valve 11 may alternatively be positioned within the first exhaust tract 3.

Figure 3:
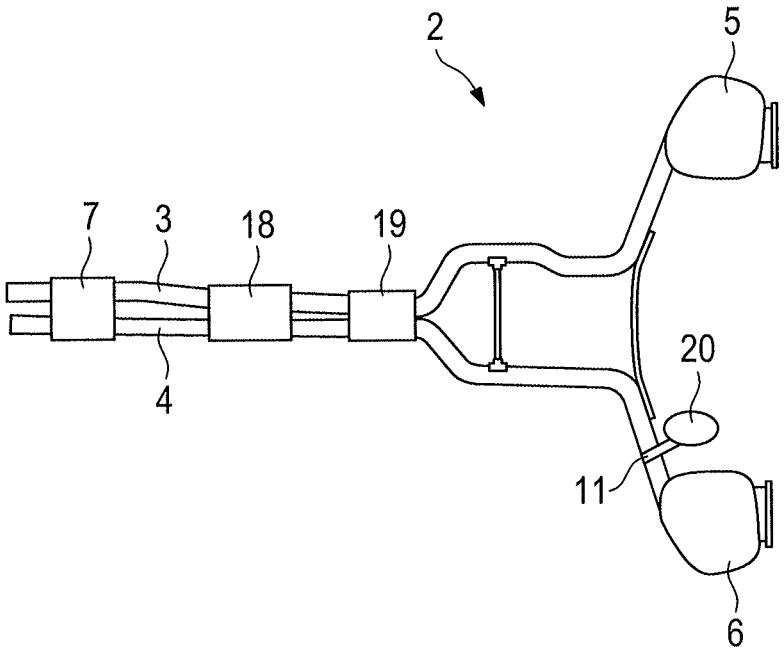
FIG. 3 is a schematic illustration of the exhaust system according to aspects of the invention, as per a third embodiment.

By means of the positioning, according to aspects of the invention, of the valve 11, it is possible for multiple advantageous effects to be attained in the critical rotational speed ranges in which disturbing droning noises arise. For example, the coherence of the two outlets of the two exhaust tracts 3 and 4 is eliminated. Furthermore, the formation of interference within the exhaust system 2 is substantially prevented. Depending on its position in the exhaust tract 4 or 3, the valve 11 acts as a switchable resonator or as a switchable reflection point. In the configuration according to aspects of the invention, the valve leads to significant influencing of the outlet noise in the exhaust tailpipes. The positioning of the crosstalk point 10 may be selected as desired in accordance with the design of the exhaust system 2. For example, if the third silencer device 7 is not selected as a crosstalk point, the crosstalk point may be realized in the form of a connecting pipe as per FIG. 3 at some other location, for example at position 18 or 19. In this illustration, the valve 11 is positioned between position 19 and the second silencer device 6. For the actuation of the valve 11, an actuating device 20 is provided which is of electrical, pneumatic or hydraulic configuration. The present invention is suitable in particular for supercharged internal combustion engines.

What is claimed is:

1. An exhaust system for an internal combustion engine, having a first exhaust tract connected to a first cylinder bank of the internal combustion engine and having a second exhaust tract connected to a second cylinder bank of the internal combustion engine, wherein a first silencer device is arranged in an end section of the first exhaust tract and a second silencer device is arranged in an end section of the second exhaust tract, and the two exhaust tracts are connected in an inter-communicating manner at a crosstalk point in the form of a connecting pipe and an exhaust-gas flap is provided in the connecting pipe, and, in the first or second exhaust tract downstream of the crosstalk point, there is provided a valve for the selective closure of the respective exhaust tract, wherein a distance between the valve and the crosstalk point is dimensioned such that, at a pre-determined rotational speed or speed range of the internal combustion engine, an exhaust line path between the valve and the crosstalk point serves as a quarter lambda resonator, wherein a control unit is configured to (i) open the valve and open the exhaust-gas flap to permit mixing of exhaust gases between the first and second exhaust tracks and direct the exhaust gas into both of the silencer devices when the first and second cylinder banks are activated, (ii) close the valve and open the exhaust-gas flap at said pre-determined rotational speed or speed range of the engine to permit mixing of exhaust gases between the first and second exhaust tracks and direct the exhaust gas into the exhaust gas track which does not include the valve when the first and second cylinder banks are activated in order to reduce disturbing noises of the exhaust system, and (iii) close the exhaust-gas flap to prevent mixing of exhaust gases between the first and second exhaust tracks.

2. The exhaust system as claimed in claim 1, wherein the valve is in the form of an exhaust-gas flap.

3. The exhaust system as claimed in claim 1, wherein the connecting pipe is in the form of a third silencer device.

4. The exhaust system as claimed in claim 3, wherein the exhaust-gas flap is provided in the third silencer device.

5. The exhaust system as claimed in claim 1, wherein the valve is configured to be actuated as a function of engine load and/or rotational speed of the internal combustion engine.

6. The exhaust system as claimed in claim 1, wherein the pre-determined rotational speed range is between 1000 rpm and 2000 rpm.

* * * * *